US005629970A

United States Patent [19]

Woodruff et al.

[11] Patent Number: 5,629,970

[45] Date of Patent: May 13, 1997

[54] EMISSIVITY ENHANCED X-RAY TARGET

[75] Inventors: David W. Woodruff, Clifton Park; Robert D. Lillquist, Niskayuna, both of N.Y.

[73] Assignee: General Electric Company, Schenectady, N.Y.

[21] Appl. No.: 583,916

[22] Filed: Jan. 11, 1996

[51] Int. Cl.[6] ..... H01J 35/08

[52] U.S. Cl. ..... 378/143; 378/127; 378/141

[58] Field of Search ..... 378/119, 125, 378/129, 139, 141, 142, 143, 144, 127

[56] References Cited

U.S. PATENT DOCUMENTS

| | | | |
|---|---|---|---|
| 4,320,323 | 3/1982 | Magendans et al. | 378/129 |
| 5,204,891 | 4/1993 | Woodruff et al. | 378/143 |

OTHER PUBLICATIONS

Bedford, "Effective Emissivities of Blackbody Cavities—A Review,. " *Temperature, Its Measurement and Control in Science and Industry,* vol. 4, (Instrument Society of America, Pittsburgh) 1972, pp: 425–434 no month.

*Primary Examiner*—Don Wong
*Attorney, Agent, or Firm*—Marvin Snyder

[57] ABSTRACT

An x-ray tube target includes an annular disk having an outer surface including front and back opposite faces, and an annular focal track fixedly joined to the disk front face for producing x-rays. The disk outer surface is rough away from the focal track, with surface roughness pits having width and depth dimensions greater than a wavelength of peak radiant emission of the target at operating temperature for increasing emissivity of the target to increase thermal radiation cooling thereof.

20 Claims, 7 Drawing Sheets

EMISSIVITY ENHANCED X-RAY TARGET

BACKGROUND OF THE INVENTION

The present invention relates generally to x-ray tubes, and, more specifically, to cooling thereof.

An x-ray tube includes an evacuated glass enclosure in which is mounted an anode target adjacent to a cathode. The target is a circular disk formed of a suitable metal or graphite or both, and is mounted to a drive shaft of a motor for rotating the target at high rotational speeds, such as about 10,000 rpm. Formed on the front face of the target is an annular focal track against which electrons from the cathode are bombarded for creating the x-rays which are emitted through the sidewall of the enclosure. The impinging electrons heat the focal track and in turn the target to substantially high temperature during operation. The x-ray tube therefore requires cooling which is typically accomplished by circulating a cooling fluid such as oil around the glass enclosure for removing the heat therefrom.

However, since a high vacuum is maintained inside the glass enclosure, heat transfer from the target to the oil surrounding the enclosure is effected primarily by thermal radiation. A typical metallic target is made of a conventional TZM material which is a molybdenum alloy with zirconium and titanium, and often includes an emissivity enhancing coating to improve thermal radiation at the high operating temperature. Targets may also be formed of graphite which inherently have relatively high emissivity without an additional emissivity enhancing coating. And, targets may be formed of both TZM and graphite suitably brazed together.

The targets are typically machined to the required final dimensions, with the machining of the graphite targets providing an outer surface from which graphite particles may be released during operation. This is undesirable since released graphite particles in the evacuated glass enclosure would degrade performance of the x-ray tube. Accordingly, graphite targets require a pyrolytic carbon infiltration (PCI) coating to prevent the liberation of graphite dust. This coating, however, can significantly reduce the emissivity of the graphite from a nominal value of about 0.825 down to as low as 0.4 depending on deposition conditions.

Due to the limited ability to effectively cool the x-ray tube target, the x-ray tube must therefore be operated intermittently in a corresponding duty cycle which ensures that the target does not exceed a predetermined operating temperature that would lead to decreased useful life of the x-ray tube. It is therefore desirable to provide enhanced cooling of the target for improving the operating duty cycle of the x-ray tube.

SUMMARY OF THE INVENTION

An x-ray tube target includes an annular disk having an outer surface including front and back opposite faces, and an annular focal track fixedly joined to the disk front face for producing x-rays. The disk outer surface is rough away from the focal track, with surface roughness pits having width and depth dimensions greater than a wavelength of peak radiant emission of the target at operating temperature for increasing emissivity of the target to increase thermal radiation cooling thereof.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
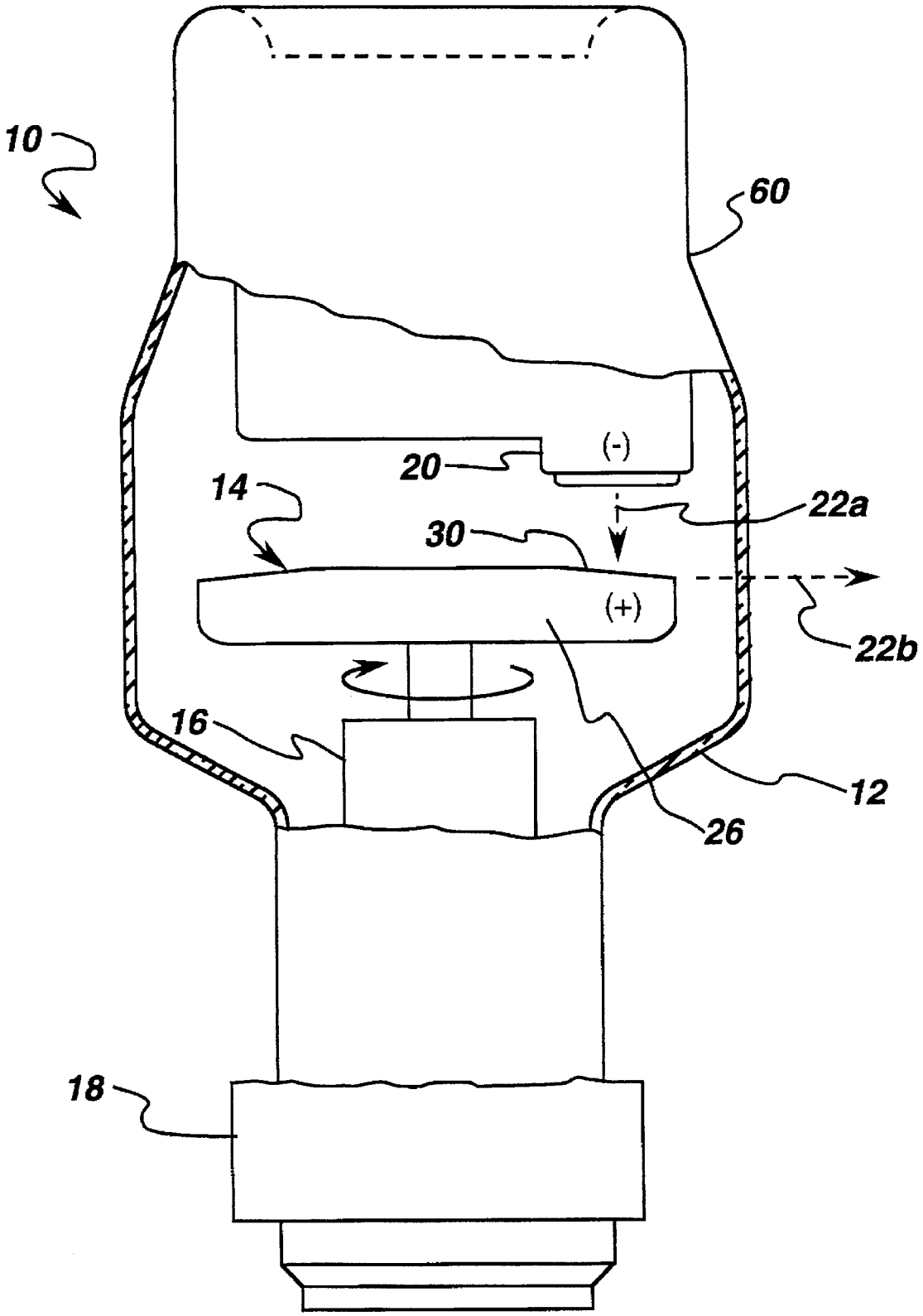
FIG. 1 is a schematic representation, partly in section, of an exemplary x-ray tube including a motor driven anode target in accordance with one embodiment of the present invention disposed adjacent to a cathode in an evacuated glass enclosure.

Illustrated schematically in FIG. 1 is an x-ray tube 10 in accordance with an exemplary embodiment of the present invention. The tube 10 includes a conventional glass envelope or enclosure 12 which is suitably sealed and evacuated for maintaining a vacuum therein. Disposed inside the enclosure 12 is an anode (+) target 14 suitably fixedly mounted coaxially with a rotor 16 for being rotated within the enclosure 12 at suitable rotational speeds R, of about 10,000 rpm for example. Surrounding one end of the enclosure 12 is a conventional stator 18 which defines with the rotor 16 a conventional electrical motor effective for rotating the target 14 at the required rotational speed.

Disposed at an opposite end of the enclosure 12 is a conventional cathode (–) 20. The target 14 and the cathode 20 are conventionally joined to a suitable power supply (not shown) so that electrons 22*a* are emitted from the cathode 20 and directed against the target 14 for developing x-rays 22*b* which are discharged from the tube 10 through the enclosure 12 in a conventionally known manner. The electrons 22*a* heat the target 14 during operation to a substantially high operating temperature, which therefore requires that the target 14 be suitably cooled during operation.

The target 14 is rotated at a suitable operating speed R for uniformly spreading the heating effect of the electrons 22*a* around the circumference of the target 14. And, since the enclosure 12 is provided with a suitable vacuum therein, heat is transferred from the target 14 by thermal radiation through the enclosure 12 to a surrounding circulating oil bath (not shown) for removing heat therefrom in a conventional manner. In accordance with the present invention, the target 14, as well as the rotor 16, may have improved emissivity for increasing thermal radiation therefrom during operation to enhance the cooling effectiveness of the tube 10. In this way, the tube 10 may be operated at a higher duty cycle, which therefore increases the productivity of the x-ray tube 10.

Figure 2:
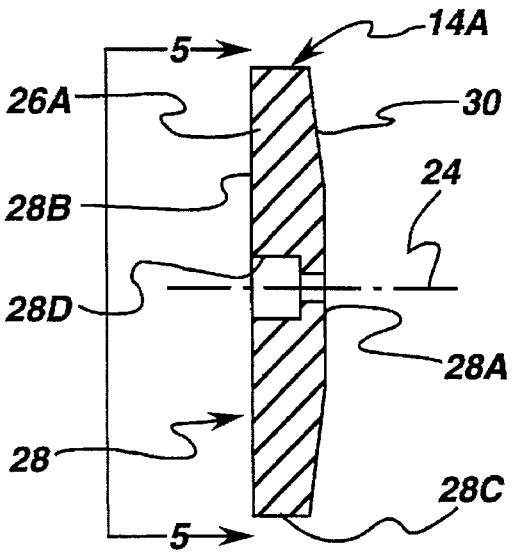
FIG. 2 is an elevational sectional view of the target shown in FIG. 1 illustrating a first metallic embodiment thereof.
Figure 3:
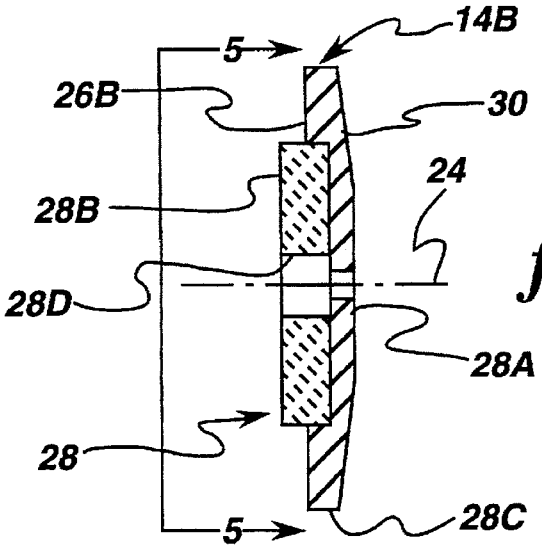
FIG. 3 is an elevational sectional view of the target shown in FIG. 1 in accordance with a second embodiment including an integral graphite and metallic disk.
Figure 4:
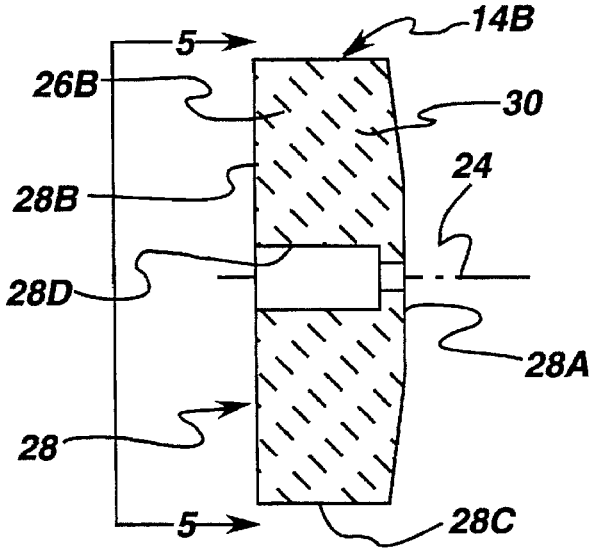
FIG. 4 is an elevational sectional view of the target shown in FIG. 1 illustrating a third graphite embodiment thereof.

More specifically, FIGS. 2–4 illustrated three exemplary embodiments of the improved x-ray target designated generally by the prefix 14, with three exemplary embodiments 14A, 14B, and 14C being illustrated. The first target 14A illustrated in FIG. 2 is formed solely of a conventional metal such as TZM which is a molybdenum alloy with zirconium and titanium. The second target 14B illustrated in FIG. 3 is in part metal such as TZM, with a graphite backing portion. And, the third target 14C illustrated in FIG. 4 is solely graphite. Each of the targets illustrated in FIGS. 2–4 is conventional in overall configuration and construction, and is axisymmetrical about an axial centerline axis 24 for maintaining suitable vibratory balance at the high operating rotational speed R.

However, any embodiment of an x-ray target such as the three exemplary embodiments illustrated in FIGS. 2–4 may be modified in accordance with the present invention for having suitable surface roughness for improving thermal radiation emissivity therefrom. Increased thermal emissivity increases the amount of heat radiated outwardly through the enclosure 12 illustrated in FIG. 1 for improving the cooling of the tube 10 for allowing a higher duty cycle of operation. The various x-ray targets such as those illustrated in FIGS. 2–4 are similar in construction with each including a circular or annular disk designated generally by the prefix 26, having an outer surface 28 including front and back opposite faces 28*a* and 28*b*, respectively. Each disk also has an outer perimeter 28*c*. Each of the disks includes a center bore 28*d* which allows the disk to be conventionally removably mounted coaxially with the rotor 16 for being rotated at speed in the tube 10.

Each of the disks 26 illustrated in FIGS. 2–4 also includes a conventional annular focal track 30, which is a suitable alloy such as tungsten-rhenium, which is conventionally fixedly joined coaxially to the disk front face 28*a* for producing x-rays upon impingement thereof by the electrons 22*a* illustrated in FIG. 1. The disk front face 28*a* is typically inclined to define a frustoconical surface on which the focal track 30 is secured for obtaining proper alignment between the impinging electrons 22*a* and the emitted x-rays 22*b*. The disk back face 28*b* is typically flat. During operation, the disk 26 is rotated to the operating speed R, and the focal track 30 is bombarded with the electrons 22*a* to produce the x-rays 22*b*. Electron bombardment also causes heating of the disk 26 to a steady state operating temperature limited by the strength characteristics of the target 14 at the high speed operation thereof for obtaining a suitable useful life thereof.

In accordance with the present invention, the disk outer surface 28 is suitably rough in all desired locations away from the focal track 30, which itself is relatively smooth, for increasing thermal radiation emissivity and therefore increasing cooling of the target 14.

Figure 5:
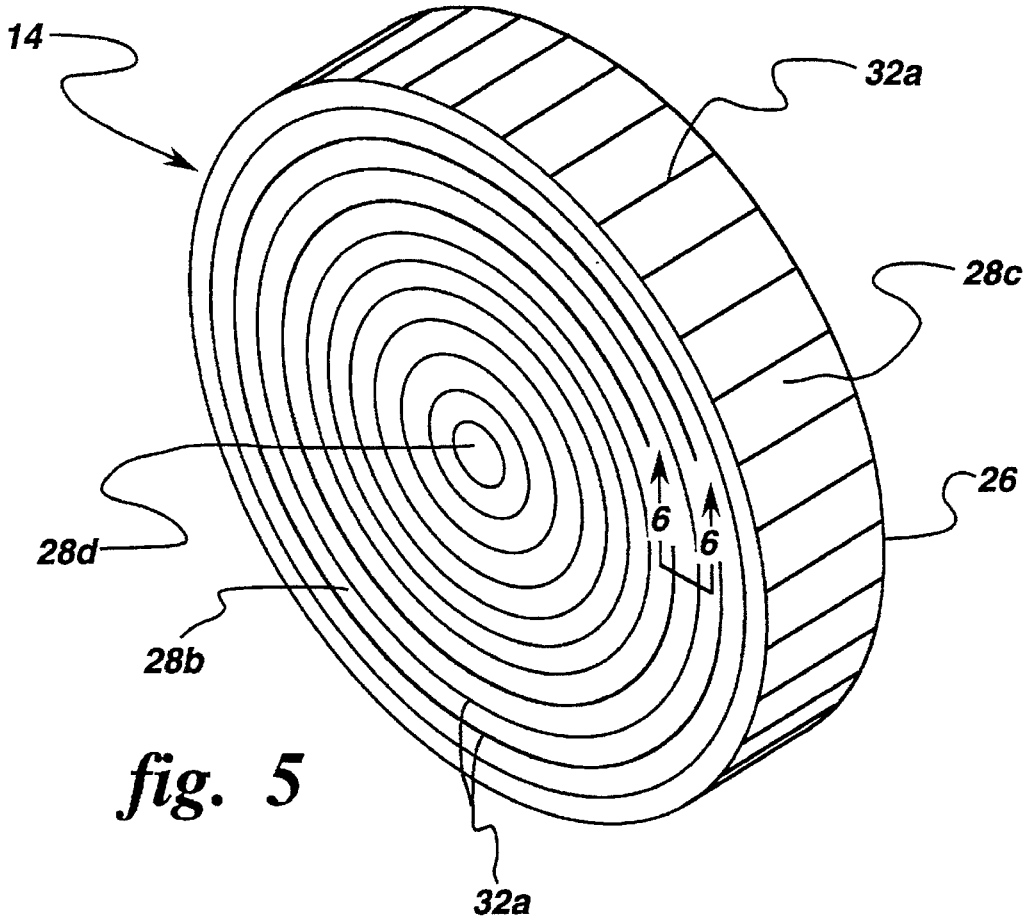
FIG. 5 is a schematic end view of the back face and perimeter of an exemplary target such as the three embodiments shown in FIGS. 2–4, illustrating schematically an exemplary embodiment of the surface roughness in the form of V-grooves therein.
Figure 6:
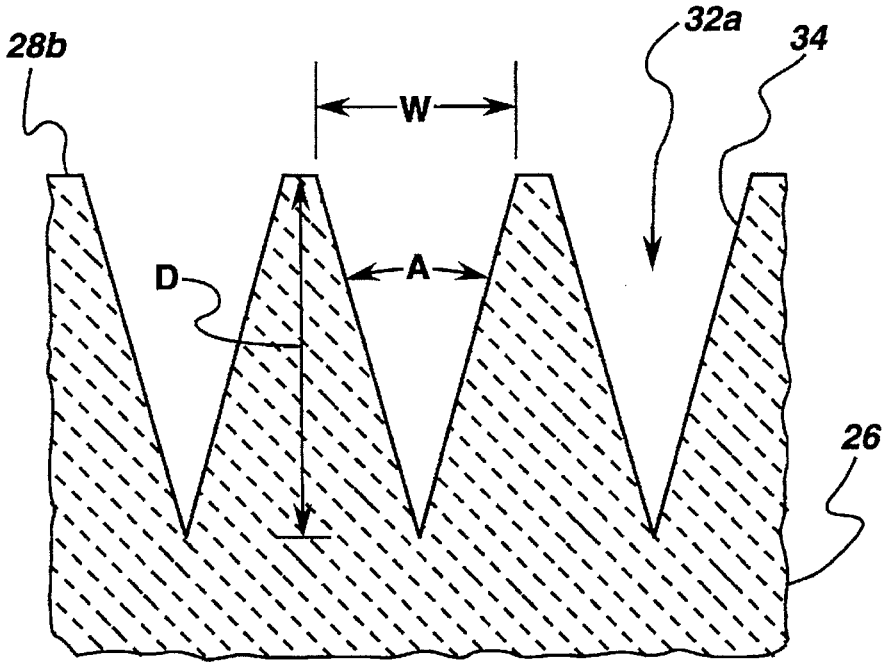
FIG. 6 is an enlarged sectional view of exemplary ones of the grooves illustrated in FIG. 5 and taken generally along line 6—6.

FIGS. 5 and up illustrate several embodiments of outer surface roughness which may be applied to any type of target indicated generally by the numeral 14, which includes the three embodiments of the targets 14A–C illustrated in FIGS. 2–4 in particular. Referring initially to FIGS. 5 and 6, the preferred roughness of the outer surface 28 may be provided at any portion thereof away from the focal track 30 itself which is unaltered for maintaining its effectiveness as a focal track. The surface roughness is characterized by surface roughness pits designated generally by the prefix 32, with one exemplary embodiment thereof being illustrated in FIGS. 5 and 6 as V-shaped grooves 32*a*.

The various embodiments of the pits 32 must be specifically configured in accordance with the present invention for ensuring effective increase in thermal radiation emissivity, as well as being disposed substantially uniformly around the disk 26 for maintaining vibratory balance of the target 14 at the operating speed. Since the target 14 must be suitably balanced both statically and dynamically for smooth operation at speed, the pits 32 should be uniformly distributed for maintaining effective balance without requiring additional balancing accommodations.

As shown in FIG. 6, the pits, or grooves 32*a*, have characteristic dimensions such as a width W and a depth D which are selected for being greater than the wavelength of peak radiant emission of the target at its operating temperature for increasing thermal radiation emissivity of the target to increase thermal radiation cooling thereof. As shown in FIG. 6, the depth D is also preferably greater than the width W of the pit or groove 32*a* for providing enhanced performance.

More specifically, the conventionally known Wien's displacement law may be used to calculate the wavelength in microns of the peak radiant emission of a body at an operating temperature in degrees Kelvin (°K.) which is simply the constant 2897 microns-°K. divided by the temperature in °K. of the body. About 75% of thermal radiation is generated at a wavelength above the peak radiant wavelength, with the remainder being generated below the peak radiant wavelength. Accordingly, the pit width W is preferably greater than the peak radiant wavelength, and should be substantially much greater than that wavelength for ensuring substantially 100% thermal radiation. Similarly, the pit depth D should be greater than the peak radiant wavelength, and is preferably substantially much greater than the peak radiant wavelength by a factor of 2 or more. In this way, substantially 100% thermal radiation may be effected by the variously configured pits 32.

The V-grooves 32*a* illustrated in FIG. 6 have a preferably acute included angle A which should be made as small as practical. The apparent emissivity as a function of the V-groove angle A was calculated for different base emissivities ranging from 0.2 to 0.9 for an included 180° angle A. Corresponding curves were generated for each of the base emissivities down to a shallow included angle A of 5°. The calculations indicate increasing emissivity as the included angle A decreases, with the greatest increase in emissivity occurring for the initially low base emissivity, and less increase occurring for the highest base emissivity. In all examples of materials ranging in initial emissivity from 0.2 to 0.9, the corresponding emissivity at the included angle A of 5° ranged from 0.862 to 0.997, respectively. The calculations indicate that the included angle A should be as small as possible to maximize the improvement in emissivity.

In the exemplary embodiment illustrated in FIG. 6, the grooves 32*a* are formed in a graphite disk, such as the disk 14C illustrated in FIG. 4, with the included angle A being about 30°. There is a practical trade off between increasing emissivity as the included angle A approaches zero due to the difficulty of cutting a groove with a correspondingly small angle. Although graphite is fragile to machine, it is possible to cut a 30° groove therein for obtaining improved emissivity.

The V-grooves 32*a* may take various configurations such as the concentric grooves illustrated in FIG. 1 in the back face 28*b* of the target 14, as well as V-grooves 32*a* extending axially on the perimeter 28*c* of the disk 26, which are circumferentially spaced apart from each other.

Figure 7:
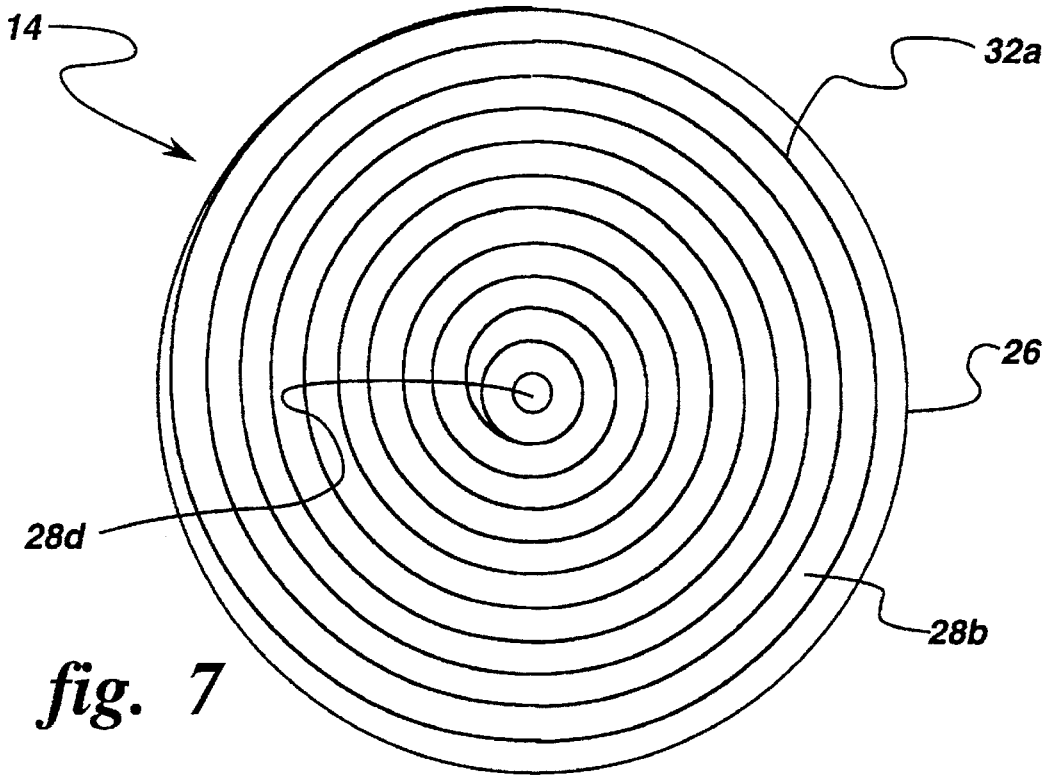
FIG. 7 is an end view of an x-ray target in accordance with another embodiment having spiral V-grooves therein.

FIG. 7 illustrates an alternate embodiment of the target 14 wherein the V-grooves 32*a* spiral in one or more generally concentric spirals on the disk back face 28*b*.

In a simple test conducted, graphite pieces were machined with a spiral V-groove which had a 30° included angle A and were cut to a depth D of about 2.38 mm. Uncoated graphite of this type has an emissivity of 0.825 to a 0.845 without the grooves. The piece with the spiral groove had an emissivity of 0.964 which is a substantial improvement. As indicated above, graphite when used in an x-ray tube 10 is coated with a PCI coating which inherently reduces the resulting emissivity. A spiral groove graphite piece coated in the same PCI run had an emissivity of 0.962 which is about equal to the emissivity of 0.964 without the coating. This unexpected result indicates that the V-grooves are effective for increasing emissivity, without a significant decrease in emissivity upon application of the PCI coating which typically occurs on smooth graphite.

Accordingly, in the exemplary embodiment illustrated in FIG. 6, the grooves 32*a* preferably also include a thin pyrolytic carbon infiltration (PCI) coating 34 thereon that maintains the width W and depth D dimensions greater than the peak radiant wavelength. The included angle A of the grooves 32*a* is preferably made as small as possible and less than about 30° where possible in either metallic or graphite target material, or in any other suitable material.

Figure 8:
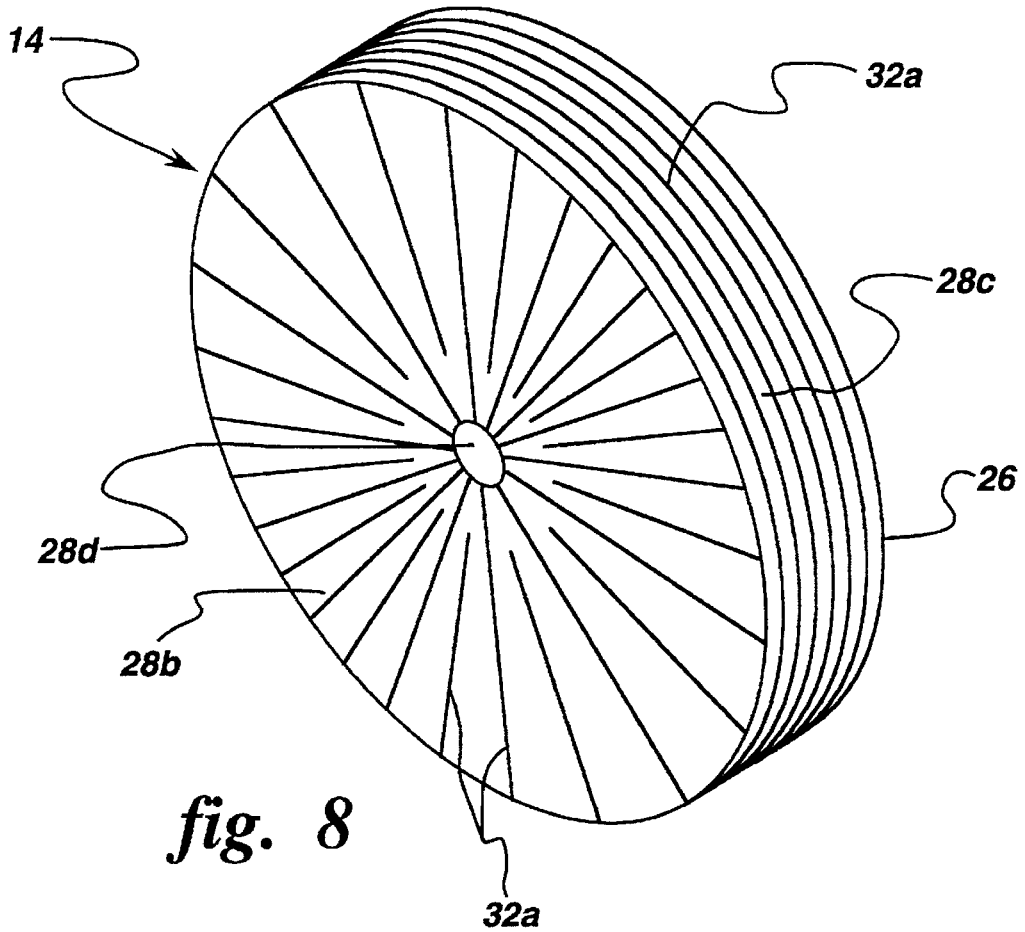
FIG. 8 is an end view of an x-ray target in accordance with another embodiment having radial V-grooves therein.

FIG. 8 illustrates yet another embodiment of the target 14 wherein the V-grooves 32*a* extend radially on the back face 28*b*, and are preferably equiangularly spaced apart from each other for maintaining suitable balance of the target 14. Also in this exemplary embodiment, additional V-grooves 32*a* may extend circumferentially around the perimeter 28*c* of the disk 26, and are uniformly axially spaced apart from each other.

Figure 9:
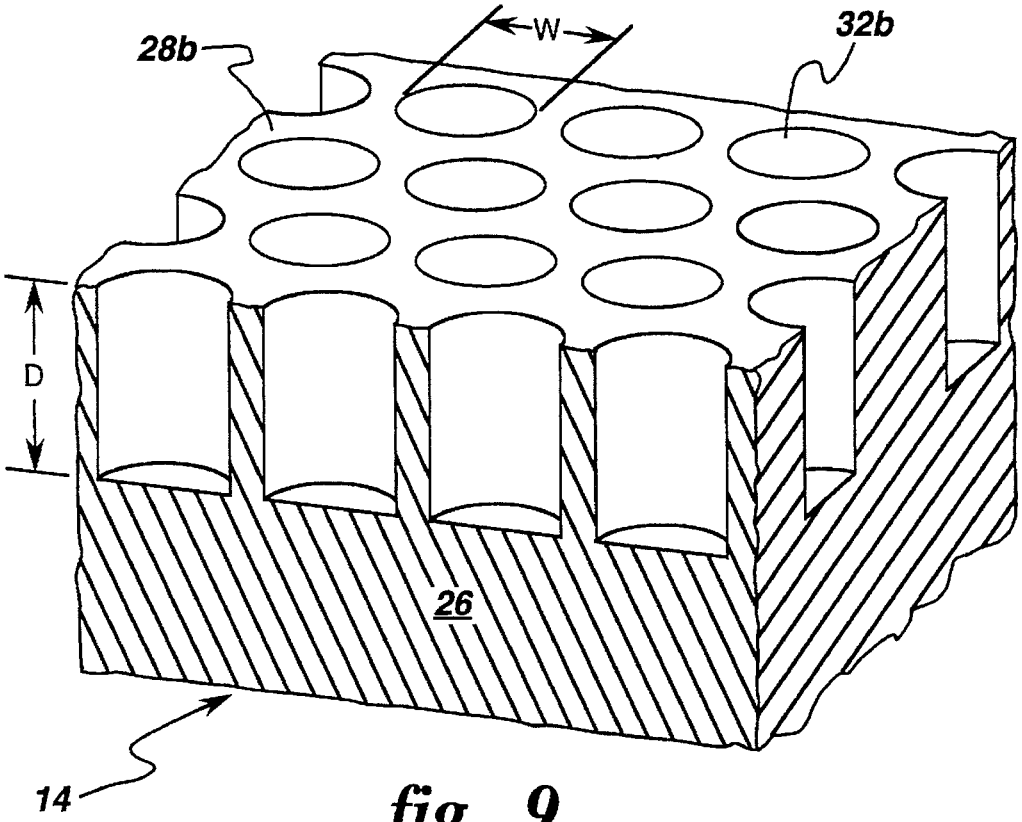
FIG. 9 is an isometric view of a portion of an x-ray target in accordance with another embodiment having roughness pits in the form of laterally spaced apart right-cylindrical cavities in the surface thereof.

FIG. 9 illustrates yet another embodiment of the target 14 wherein the roughness pits comprise a plurality of laterally spaced apart right-cylindrical cavities 32*b* each having a width W represented by its diameter, and a depth D represented by its length into the back face 28*b*. These characteristic width and depth dimensions are similarly greater than the peak radiant wavelength described above, with the depth being suitably larger than the width W.

Figure 10:
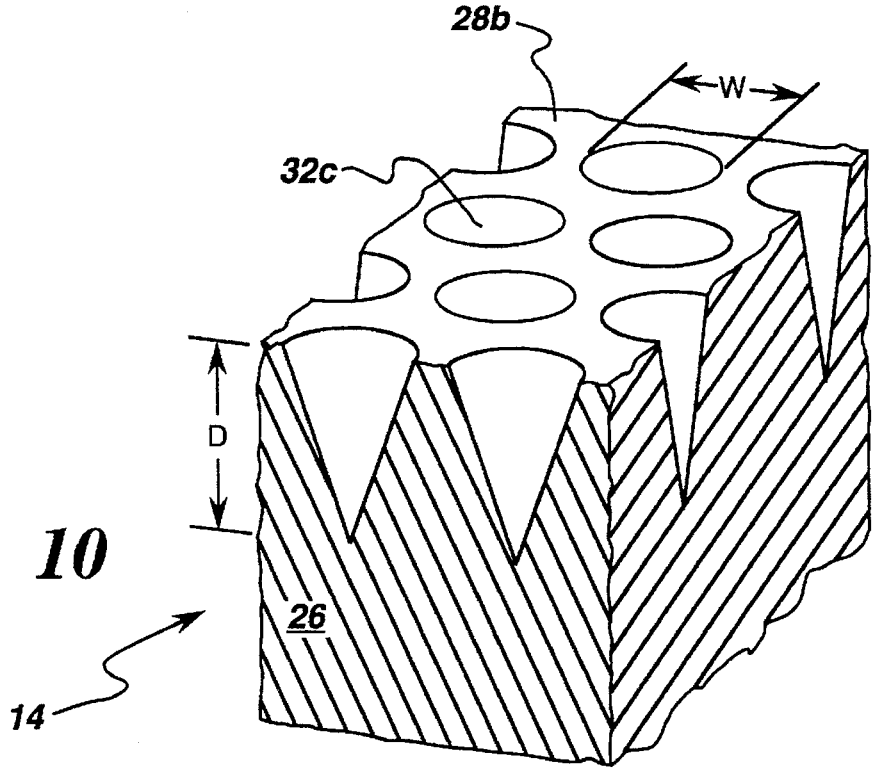
FIG. 10 is an isometric view of a portion of an x-ray target in accordance with another embodiment having roughness pits in the form of laterally spaced apart conical cavities in the surface thereof.

FIG. 10 illustrates yet another embodiment of the target 14 wherein the roughness pits comprise a plurality of laterally spaced apart conical cavities 32*c* having a maximum width W represented by the diameter at the back face 28*b*, with a depth D being the height of each cone cavity 32*c* into the back face 28*b*. The conical cavities 32*c* similarly meet the width and depth requirements described above being greater than the peak radiant wavelength.

In both embodiments illustrated in FIGS. 9 and 10, the cylindrical or conical pits 32*b, c* are preferably close-packed as tightly as possible for maximizing the emissivity over the back face 28*b*, and may be similarly provided around the perimeter 28*c* as desired.

The grooves 32*a*, the cylindrical cavities 32*b*, and conical cavities 32*c* disclosed above may be formed by any suitable method including machining and drilling for example. It is also possible to provide enhanced emissivity surface roughness by the use of conventional chemical etching, oxidation, or burning. A tradeoff may exist in these methods that limits the maximum width and depth dimensions of the resulting roughness pits against any reduction in structural integrity near the surface of the material. This tradeoff applies equally as well for the various configurations of the pits 32*a–c* described above.

Figure 11:
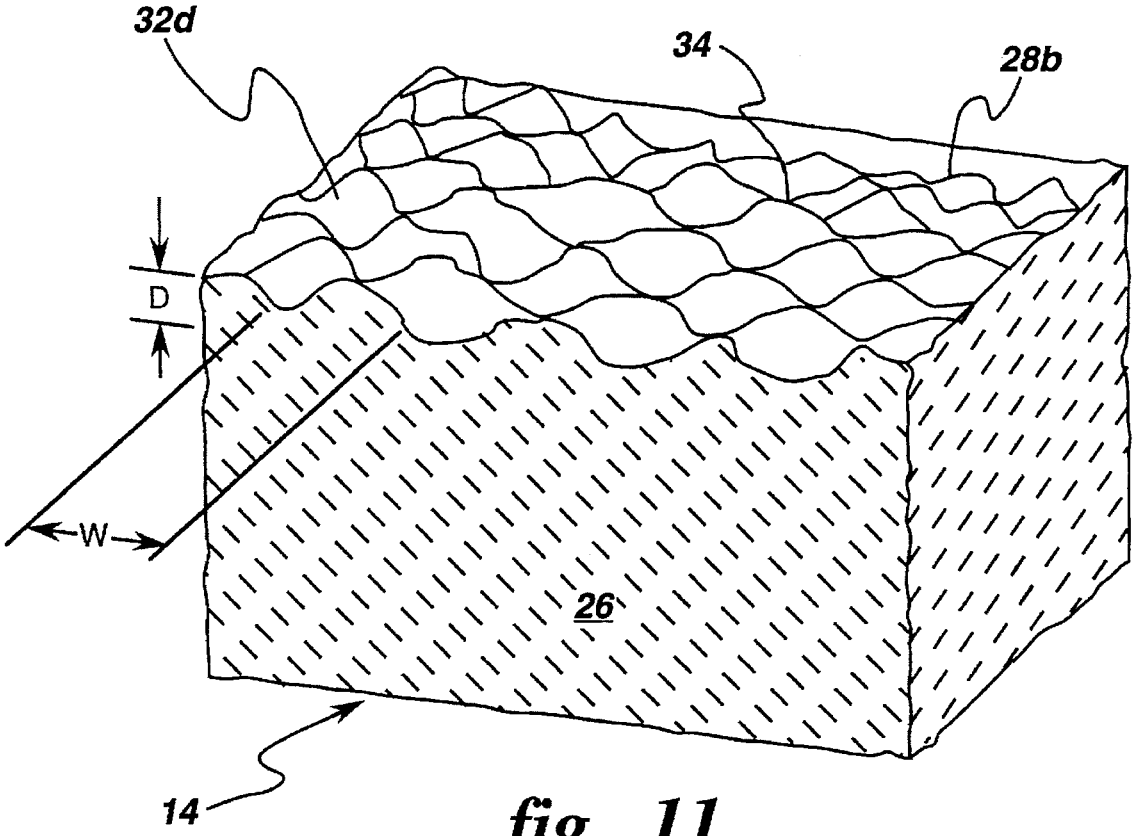
FIG. 11 is an isometric view of a portion of an x-ray target in accordance with another embodiment having surface roughness in the form of burned cavities in the surface thereof.

FIG. 11 illustrates schematically yet another embodiment of the target 14 wherein the disk 26 is formed of graphite and the surface pits are defined as burned cavities 32*d* formed in the back face 28*b*, as well as the perimeter 28*c* if desired, by burning or combusting the graphite for suitable amount of time. Since graphite can be burned, the burning process may be used to develop suitably sized cavities 32*d* preferably having the characteristic width W and depth D described above being greater than the peak radiant wavelength for enhancing emissivity. Burning of graphite necessarily turns the outer surface black which itself provides enhanced emissivity since black is recognized for being a highly emissive thermal radiator. The developed burned cavities 32*d* can enhance thermal emissivity.

Additional tests were conducted wherein graphite pieces were burned in air at 800° C. at various pressures and for various times. In one example, graphite pieces were burned in air at atmospheric pressure for one hour. An uncoated graphite piece had an emissivity of 0.876 after burning which is significantly greater than a corresponding emissivity of 0.832 without burning. Additional graphite pieces were burned and then PCI coated and had an average emissivity of 0.861 which was substantially greater than an average emissivity of 0.774 for unburned PCI coated pieces in the same run. These tests indicate the enhanced emissivity which may be obtained by simply burning graphite pieces to effect the outer surface thereof. These tests also indicate that the PCI coating of burned graphite pieces reduces the emissivity thereof substantially less than would be expected by simply PCI coating unburned graphite pieces, which is unexpected. Accordingly, in the exemplary embodiment illustrated in FIG. 11, the burned cavities 32*d* preferably also are covered with the PCI coating 34 for use as an effective target 14 in the x-ray tube 10.

Further tests were conducted in which graphite pieces were burned in air at 50 torr for various times. Burning for 30 minutes at this pressure did not improve emissivity. Burning for one hour increased average emissivity from 0.832 to 0.869 before PCI deposition. Burning for 1.5 hours increased emissivity from 0.832 to 0.865. And, PCI coating dropped the emissivities on all samples.

Figure 12:
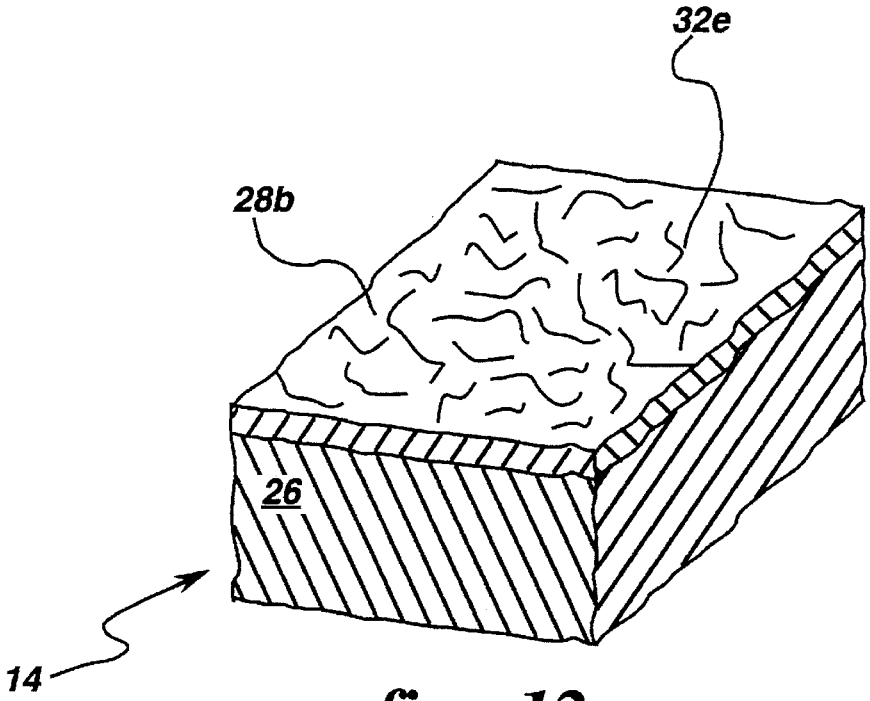
FIG. 12 is an isometric view of a portion of an x-ray target in accordance with another embodiment having surface roughness in the form of chemically etched or oxidized recesses.

FIG. 12 illustrates yet another embodiment of the target 14 wherein the roughness pits comprise a plurality of laterally spaced apart chemically etched recesses 32*e*, which are formed therein by any suitable chemical etching process. The resulting etched recesses 32*e* are also of sufficient size for enhancing thermal emissivity. And, chemical oxidation may alternatively be used for providing a corresponding oxide layer over the target surface having enhanced emissivity.

Figure 13:
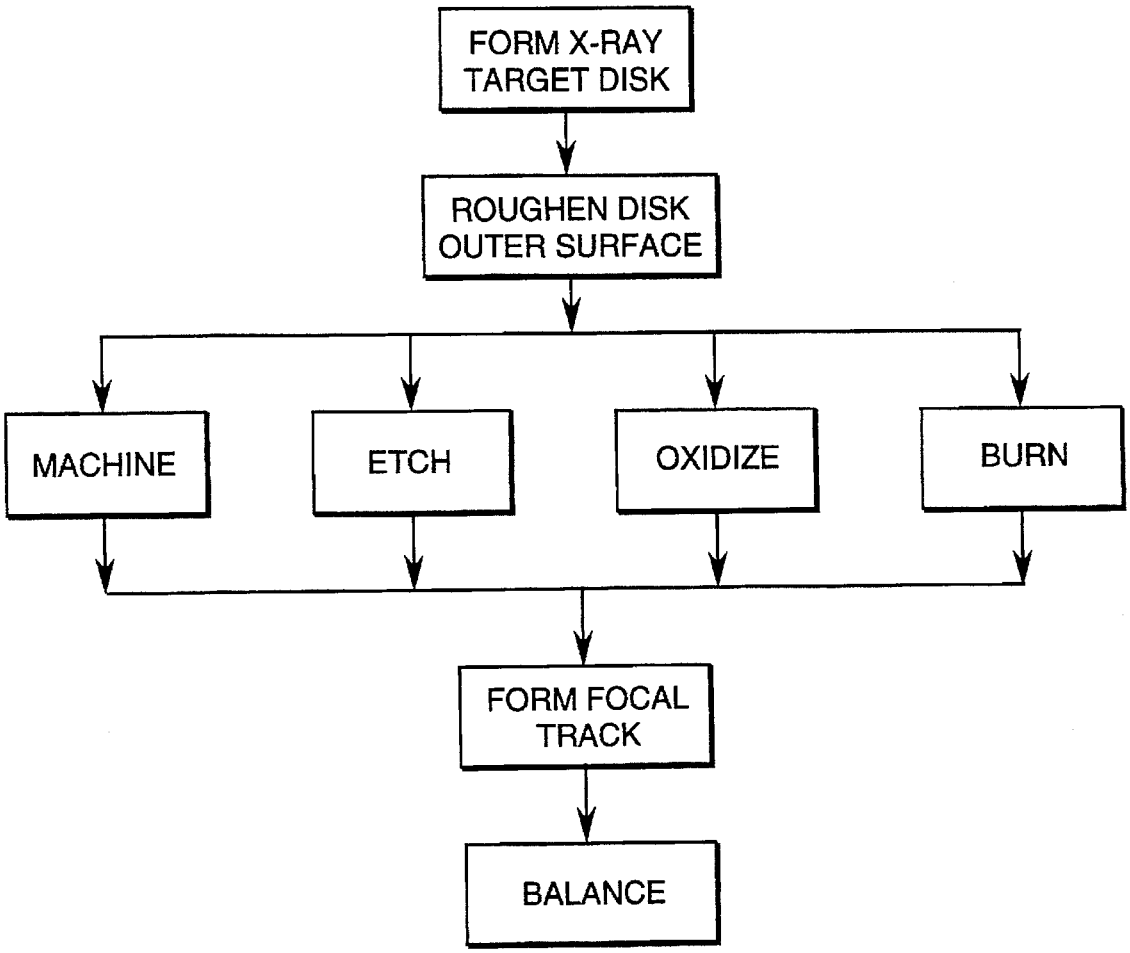
FIG. 13 is a flowchart representation of an exemplary embodiment of a method of forming x-ray targets with surface roughness in accordance with one embodiment of the present invention.

FIG. 13 illustrates in flowchart form a summary of the various methods of making the target 14 for use in the x-ray tube 10 at high operating temperature and speed. The target disk may be initially formed by any conventional manner for providing an initial disk of suitable metal, graphite, or integral combination thereof. The disk is then roughened over its outer surface for obtaining any one of the various surface roughness pits 32 described above. For example, the V-grooves 32*a* may be formed by conventional machining on a lathe. The cylindrical and conical cavities 32*b, c* may be formed by drilling. The burned cavities 32*d* may be formed by burning the surface of the graphite as described above. After burning of the graphite disk, a suitable PCI coating may then be conventionally applied. The etched recesses 32*e* may be formed by suitable chemical etching. And the oxidation layer may be formed by suitable oxidation of the disk outer surface.

And for all the embodiments described above, a suitable focal track 32 may then be formed and attached to the disk 26, by brazing for example. The target 14 may then be suitably balanced in any conventional manner for ensuring smooth operation at the high rotation speed.

The various embodiments of the surface roughness pits described may be applied over the entire outwardly radiating surface of the target 14 other than on the focal track 30 itself for maintaining effective x-ray performance of the focal track 30. As shown in FIG. 1, the rotor 16 forms an extension of the target 14 and is therefore heated thereby. Accordingly, the various surface roughness pits described above may also be extended to any desired location of the rotor 16 for increasing radiation emissivity thereof.

The enhancements in radiation emissivity of the various embodiments of the target 14 described above increase heat transfer outwardly through the enclosure 12 and into the circulating oil heat sink. The x-ray tube 10 may therefore be operated at a higher operational duty cycle for improving the productivity of the x-ray tube 10, while still maintaining a suitable effective life.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

We claim:

1. A target operable at operating temperature and rotary speed in an x-ray tube comprising:

an annular disk having an outer surface including front and back opposite faces;

an annular focal track fixedly joined to said disk front face for producing x-rays upon electron impingement thereof, and for heating said disk to said operating temperature; and said disk outer surface being rough away from said focal track, with surface roughness pits having width and depth dimensions greater than a wavelength of peak radiant emissions of said target at said operating temperature for increasing emissivity of said target to increase thermal radiation cooling thereof, and said surface roughness being disposed substantially uniformly around said disk for maintaining vibratory balance of said target at said operating speed.

2. A target according to claim 1 wherein said pit depth is greater than said pit width.

3. A target according to claim 2 wherein said roughness pits comprise V-shaped grooves.

4. A target according to claim 3 wherein said grooves have an acute included angle.

5. A target according to claim 4 wherein said disk is graphite, and said acute angle is about 30°.

6. A target according to claim 4 wherein said grooves are concentric with each other on said back face.

7. A target according to claim 4 wherein said grooves spiral on said back face.

8. A target according to claim 4 wherein said grooves extend radially on said back face, and are equiangularly spaced apart from each other.

9. A target according to claim 4 wherein said grooves extend circumferentially around a perimeter of said disk.

10. A target according to claim 4 wherein said grooves extend axially on a perimeter of said disk, and are circumferentially spaced apart from each other.

11. A target according to claim 2 wherein said roughness pits comprise a plurality of laterally spaced apart cylindrical cavities.

12. A target according to claim 2 wherein said roughness pits comprise a plurality of laterally spaced apart conical cavities.

13. A target according to claim 2 wherein said roughness pits comprise a plurality of laterally spaced apart burned cavities.

14. A target according to claim 2 wherein said roughness pits comprise a plurality of laterally spaced apart chemically etched recesses.

15. A target according to claim 2 wherein said disk is graphite, and further comprising a pyrolytic carbon infiltration coating atop said roughness pits that maintains said width and depth dimensions greater than said peak radiant wavelength.

16. A target according to claim 15 wherein said roughness pits comprise V-shaped grooves having an acute included angle less than about 30°.

17. A method of making a target operable at operating temperature and rotary speed in an x-ray tube comprising:

forming an annular disk having an outer surface including front and back opposite faces;

roughening said disk outer surface to obtain surface roughness pits having width and depth dimensions greater than a wavelength of peak radiant emission of said target at said operating temperature for increasing emissivity of said target to increase thermal radiation cooling thereof, and said surface roughness being disposed substantially uniformly around said disk for maintaining vibratory balance of said target at said operating speed; and forming an annular focal track fixedly joined to said disk front face for producing x-rays upon electron impingement thereof, and for heating said disk to said operating temperature.

18. A method according to claim 17 wherein said roughening step includes at least one of machining and chemical formation of said pits.

19. A method according to claim 18 wherein said roughening step includes chemical etching.

20. A method according to claim 18 wherein said disk is graphite, and said roughening step includes burning said disk outer surface to form said pits.

* * * * *